US007835682B2

(12) United States Patent
Nishida et al.

(10) Patent No.: US 7,835,682 B2
(45) Date of Patent: Nov. 16, 2010

(54) IMAGE FORMING APPARATUS AND CLEANING CONTROL SECTION

(75) Inventors: Satoshi Nishida, Saitama (JP); Hiroshi Morimoto, Tokyo (JP); Kazuteru Ishizuka, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 138 days.

(21) Appl. No.: 12/042,415

(22) Filed: Mar. 5, 2008

(65) Prior Publication Data

US 2009/0116862 A1 May 7, 2009

(30) Foreign Application Priority Data

Jun. 11, 2007 (JP) ..... 2007-153751

(51) Int. Cl.
*G03G 21/00* (2006.01)
*A46B 15/00* (2006.01)

(52) U.S. Cl. ..... 399/354; 399/71; 399/123; 399/343; 399/353; 15/256.5; 15/356.51; 15/356.52

(58) Field of Classification Search ..... 339/71, 339/107, 110, 123, 343, 349, 353, 354; 15/256.5, 15/256.51, 256.52
See application file for complete search history.

(56) References Cited

U.S. PATENT DOCUMENTS 4,989,047 A * 1/1991 Jugle et al. ..... 399/349
7,043,187 B2 * 5/2006 Brown et al. ..... 399/343
7,520,572 B2 * 4/2009 Hatipoglu et al. ..... 303/3
2004/0018033 A1 * 1/2004 Hayashida ..... 399/349
2008/0193178 A1 * 8/2008 Sugimoto et al. ..... 399/354

FOREIGN PATENT DOCUMENTS

JP 59189382 A * 10/1984
JP 62157082 A * 7/1987
JP 8-115024 A 5/1996
JP 8-160818 A 6/1996
JP 9-179471 A 7/1997
JP 2001-158564 6/2001
JP 2006-171070 A 6/2006

OTHER PUBLICATIONS

Japanese Office Action for Japanese Patent Application No. 2007-153751 mailed Apr. 21, 2009 with English translation.

* cited by examiner

*Primary Examiner*—David P Porta
*Assistant Examiner*—Casey Bryant
(74) *Attorney, Agent, or Firm*—Cantor Colburn LLP

(57) ABSTRACT

Disclosed is an image forming apparatus, comprising: an image carrier; a brush to remove toner remaining on the image carrier by scrubbing a surface of the image carrier; a flicker to remove the toner adhering to the brush by contacting to the brush; a brush driving section to rotate the brush; and a control section to obtain a quantity of the toner adhering to the brush and to control the brush driving section so as to change a rotation speed of the brush based on the obtained quantity of the toner.

5 Claims, 6 Drawing Sheets

IMAGE FORMING APPARATUS AND CLEANING CONTROL SECTION

BACKGROUND OF THE INVENTION

1. Field of the Invention

The present invention relates to an image forming apparatus for forming a toner image on a sheet by using an image carrier.

2. Description of Related Art

An image forming apparatus of an electrophotographic system, such as a copier and a printer and the like, forms a latent image on a photosensitive body (image carrier) which is uniformly charged, by performing a selective exposure of the photosensitive body, and visualizes the latent image with toner. The image forming apparatus then transfers the visualized image to a recording medium to perform image recording. The image forming apparatus then removes the toner remaining on the photosensitive body after the transfer with a cleaning blade, and performs the next image forming operation by the use of the photosensitive body, the surface of which is cleaned.

The image forming apparatus outputs not only a character image but also a high definition photographic image. Consequently, the image forming apparatus is required to form an image with a high accuracy and a high definition.

Under such a situation, the toner to be used for image formation has been shifting from mechanically pulverized non-uniform toner to spherical small particle diameter toner produced by a chemical reaction, such as a polymerization reaction and the like. However, in the case of the conventional cleaning method using only the cleaning blade, the spherical small particle diameter toner that remains on the photosensitive body after the transfer slips through the cleaning blade to produce defective cleaning.

Accordingly, a cleaning method of providing a brush on the upstream side of the cleaning blade for the purpose of assisting the cleaning blade to remove the toner remaining on the photosensitive body with the brush together with the cleaning blade was proposed.

By the method, even the spherical small particle diameter toner is efficiently removed from the photosensitive body, and the defective cleaning is decreased. However, when much toner adheres to the brush, the adhered toner is scrubbed by the brush and the photosensitive body to be broken to be smaller. When the broken toner is transferred onto the photosensitive body and reaches the cleaning blade, the method causes a problem that the broken toner is pressed by the cleaning blade to cause a fusion of the broken toner to the photosensitive body.

In consideration of this point, a technique for preventing the adherence of much toner to a brush was proposed.

A technique disclosed in Japanese Patent Application Laid-Open Publication No. 2001-158564 is the technique of applying a voltage for preventing the adherence of the toner having a negative polarity to a brush at the time of a toner consuming mode in which a great deal of toner is discharged.

The technique disclosed in Japanese Patent Application Laid-Open Publication No. 2001-158564 can prevent the adhesion of the toner having the negative polarity to the brush, but it is difficult for the technique to prevent the adhesion of the entire toner remaining on a photosensitive body to the brush because the toner remaining on the photosensitive body after transfer is not only the toner having the negative polarity, and the toner having a positive polarity also exists.

SUMMARY

Accordingly, it is an object of the present invention to provide an image forming apparatus capable of preventing the adherence of much toner to a brush to decrease the toner fusion occurring on an image carrier, such as a photosensitive body and the like.

To achieve at least one of the above objects, an image forming apparatus reflecting one aspect of the present invention comprises:

an image carrier;

a brush to remove toner remaining on the image carrier by scrubbing a surface of the image carrier;

a flicker to remove the toner adhering to the brush by contacting to the brush;

a brush driving section to rotate the brush; and a control section to obtain a quantity of the toner adhering to the brush and to control the brush driving section so as to change a rotation speed of the brush based on the obtained quantity of the toner.

BRIEF DESCRIPTION OF THE DRAWINGS

These and other objects, advantages and features of the present invention will become more fully understood from the detailed description given hereinbelow and the appended drawings, and thus are not intended as a definition of the limits of the present invention, and wherein.

DETAILED DESCRIPTION OF THE PREFERRED EMBODIMENTS

Figure 1:
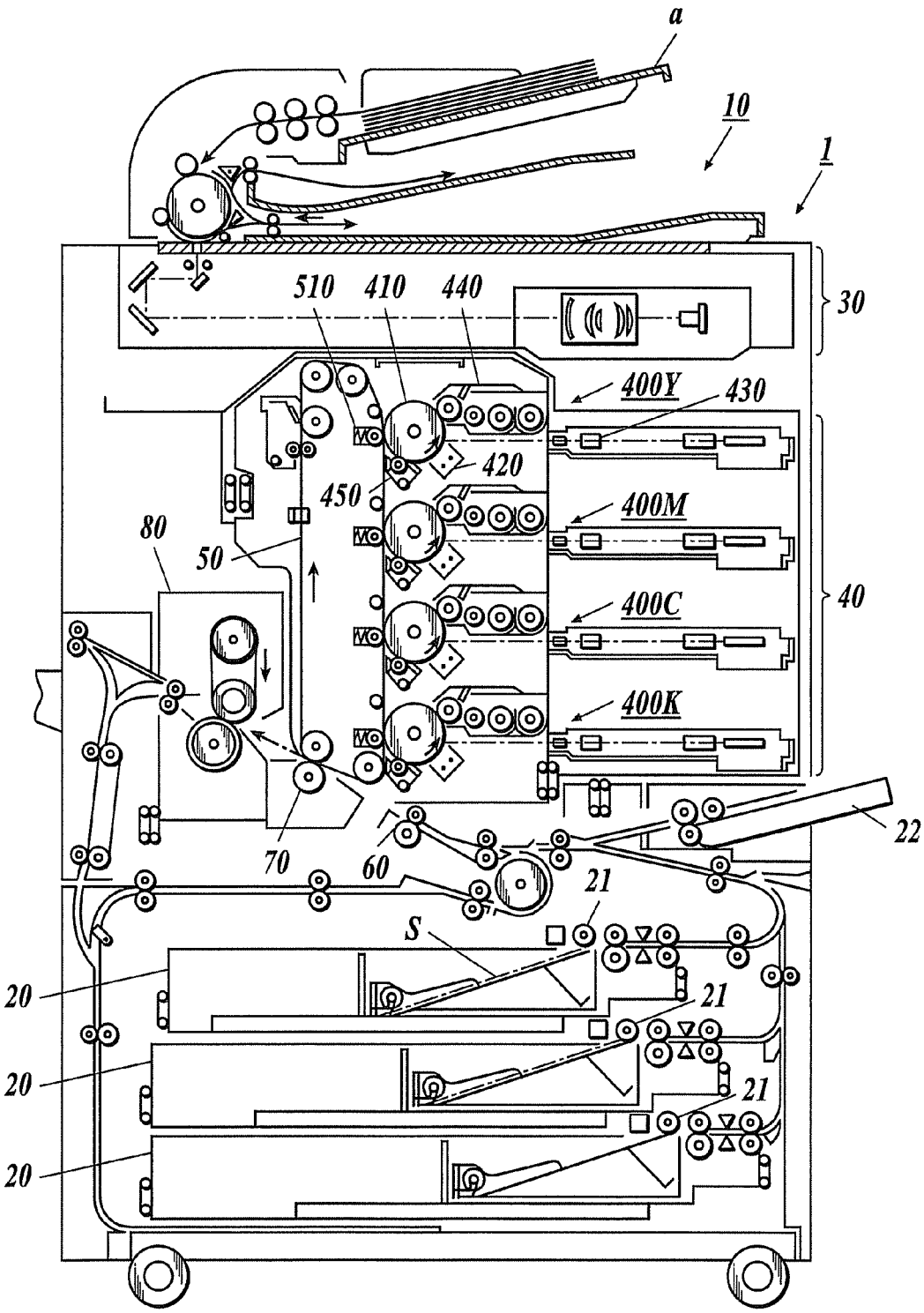
FIG. 1 is a sectional view at the center of an internal configuration of an image forming apparatus.

FIG. 1 is a sectional view at the center of the internal configuration of an image forming apparatus 1.

The image forming apparatus 1 is a tandem system color image forming apparatus comprising an intermediate transfer belt 50.

An original set on an original feed stand "a" of a both-side original automatic feeder 10 is conveyed toward an image reading section 30 with various rollers.

The image forming apparatus 1 comprises a plurality of sheet housing sections 20 in the lower part thereof. An image forming section 40 and the intermediate transfer belt 50 are installed above the sheet housing section 20, and the image reading section 30 is installed in the upper part of the apparatus main body.

The sheet housing sections 20 are configured to be able to be drawn out toward the apparatus front side (the front side of the sheet surface of FIG. 1). Sheets S, such as blank sheets, are housed in the plurality of sheet housing sections 20, divided according to the sizes thereof. The sheets S housed in the sheet housing section 20 are fed one by one with sheet feeding rollers 21. Moreover, specialty sheet, such as an over-head projector (OHP) sheet, is set at a manual feeding section 22.

The image forming section 40 includes four sets of image formation engine 400Y, 400M, 400C, and 400K for forming toner images of yellow (Y), magenta (M), cyan (C), and black (K) colors, respectively. The image formation engines 400Y, 400M, 400C, and 400K are arranged in a straight line from the upper part to the lower part in the order, and each of the image formation engines 400Y, 400M, 400C, and 400K has the same configuration. The image formation engine 400Y for yellow color is exemplified for describing the configuration. The image formation engine 400Y comprises a photosensitive body 410 rotating counterclockwise, a scorotron charging section 420, an exposing section 430, and a developing section 440.

A cleaning section 450 is arranged to comprise an area opposed to the lowermost part of the photosensitive body 410.

The intermediate transfer belt 50 situated at the central part of the apparatus main body is formed in an endless shape, and has a predetermined volume resistivity. A first transfer electrode 510 is installed at a position opposed to the photosensitive body 410 with the intermediate transfer belt 50 put between them.

Next, an image forming method for forming a color image will be described.

The photosensitive body 410 is driven by a drum driving motor (not shown) to rotate, and is charged to have a negative polarity by the discharge of the scorotron charging section 420 (for example, −800 V). Next, the exposing section 430 performs light writing according to image information onto the photosensitive body 410 to form an electrostatic latent image. When the formed electrostatic latent image passes through the developing section 440, the toner charged to have the negative polarity in the developing section 440 adheres to the part of the latent image by the application of a negative polarity developing bias, and a toner image is formed on the photosensitive body 410. The formed toner image is transferred onto the intermediate transfer belt 50 which is contacted to the photosensitive body 410 with pressure. The toner remaining on the photosensitive body 410 after the transfer is cleaned by the cleaning section 450.

The toner images formed by the respective image formation engines 400Y, 400M, 400C, and 400K are transferred onto the intermediate transfer belt 50 to be superposed on one another, and thereby a color image is formed on the intermediate transfer belt 50. The sheets S are fed one by one by the sheet housing sections 20, and the sheets S are conveyed up to the position of resist rollers 60 functioning as a resist conveyance section. The sheets S strike the resist rollers 60 and once stop. The bends of the sheets S are then cured. The sheets S are fed from the resist rollers 60 at the timing so that the image positions on the sheets S accord with those of the toner images on the intermediate transfer belt 50.

The sheets S fed from the resist rollers 60 are guided by a guide plate, and are sent into a transfer nip position formed of the intermediate transfer belt 50 and a transfer section 70. The transfer section 70 which comprises rollers, presses the sheets S to the intermediate transfer belt 50 side. When a bias (for example +500 V) having a reverse polarity to that of the toner is applied onto the transfer section 70, the toner images on the intermediate transfer belt 50 are transferred onto the sheets S by the operation of electrostatic forces. The charges on the sheets S are removed, and the sheets S are separated from the intermediate transfer belt 50 by a separation device (not shown) comprising an electricity removing needle. Then, the sheets S are sent to a fixing section 80 comprising a roller pair of a heating roller and a pressure roller. As a result, the toner images are fixed on the sheets S, and the sheets S on which the images are formed, are ejected to the outside of the apparatus.

Incidentally, although the image forming apparatus 1 of the present embodiment forms color images on sheets by an electrophotographic system, the image forming apparatus according to the present invention is not limited to the present embodiment, and may be an image forming apparatus for forming monochrome images.

Figure 2:
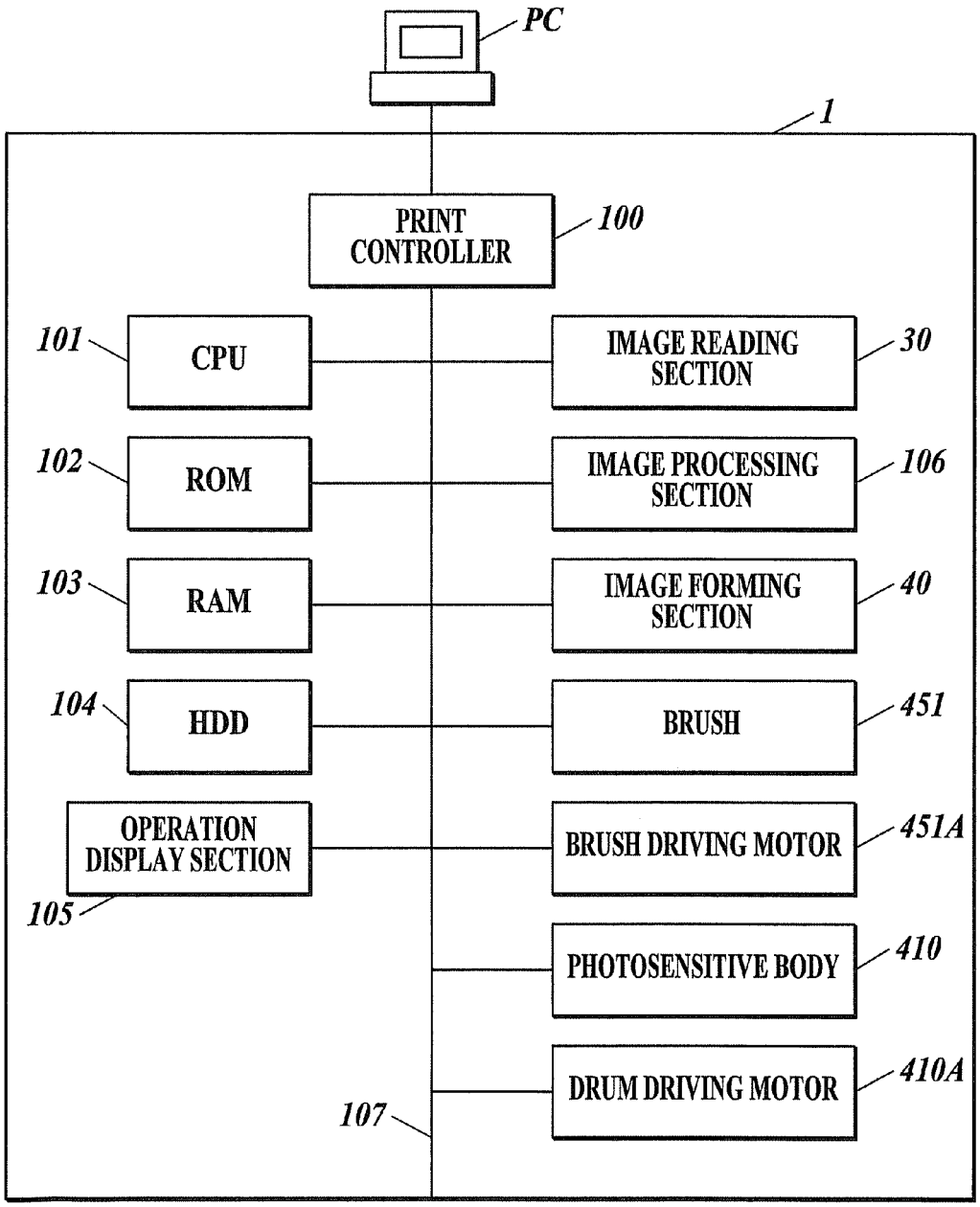
FIG. 2 is a block diagram of a control system of the image forming apparatus.

FIG. 2 is a block diagram of the control system of the image forming apparatus 1, and only shows representative components here.

A central processing unit (CPU) 101 is connected to a read only memory (ROM) 102, a random access memory (RAM) 103, and the like, through a system bus 107. The CPU 101 reads various programs stored in the ROM 102 to expand the read programs in the RAM 103, and controls the operation of each section. Moreover, the CPU 101 executes various kinds of processing in accordance with the programs expanded in the RAM 103, and stores the processing results in the RAM 103. Furthermore, the CPU 101 makes an operation display section 105 display the processing results. The CPU 101 then makes a predetermined saving destination save the processing results stored in the RAM 103. Incidentally, in the present embodiment, the CPU 101 configures a control section by cooperating with the ROM 102 and the RAM 103.

The ROM 102 previously stores programs, data, and the like, and is typically composed of a semiconductor memory.

The RAM 103 forms a work area for temporarily storing the data and the like that have been processed by the various programs executed by the CPU 101.

The HDD 104 has the function of storing the image data of an original image obtained by reading the original image with the image reading section 30 and the function of storing the image data that has been already output and the like. The HDD 104 has a structure in which several sheets of metal discs, each having a magnetic substance applied or evaporated thereon, are mutually superposed at fixed intervals, and the superposed metal discs are rotated at a high speed by a motor. A magnetic head is then brought close to the metal discs, and the reading and the writing of data are performed.

The operation display section 105 enables various settings. The operation display section 105 is configured to take, for example, a touch panel form, and the conditions pertaining to color printing and monochrome printing are set by the input of a user with the operation display section 105. Moreover, various pieces of information, such as the information of network setting and the like, are displayed in the operation display section 105.

The image reading section 30 optically reads an original image to convert the read original image into an electric signal. When the image reading section 30 reads a color original, the image reading section 30 generates image data having 10 bits of luminance information of each of the colors red (R), green (G), and blue (B), per pixel.

The image data generated by the image reading section 30 and the image data transmitted from a personal computer (PC) connected to the image forming apparatus 1 are image-processed by an image processing section 106. When the image forming apparatus 1 executes color printing, the pieces of image data of R, G, and B that have been generated by the image reading section 30 and the like are input into a color conversion look up table (LUT) in the image processing section 106, and are performed with the color conversion of the R, G, and B data into the pieces of image data of yellow (Y), magenta (M), cyan (C), and black (Bk). The image data subjected to the color conversion then receives the correction of a gradation reproducing characteristic, the screen processing of halftone dots and the like by referring to a density correction LUT, and edge processing for enhancing thin lines.

The image forming section 40 receives the image data subjected to image processing by the image processing section 106, and forms an image on a sheet.

A brush driving motor (brush driving section) 451A for rotating a brush 451 and a drum driving motor (image carrier driving section) 410A for rotating the photosensitive body 410 are connected to the CPU 101 through the system bus 107. The CPU 101 reads a predetermined program stored in the ROM 102 and expands the read program in the RAM 103. The CPU 101 controls the operation of the brush driving motor 451A and the like, the CPU 101 acting as the principal part. Incidentally, one motor may be used both as the brush driving motor 451A and the drum driving motor 410A.

Figure 3:
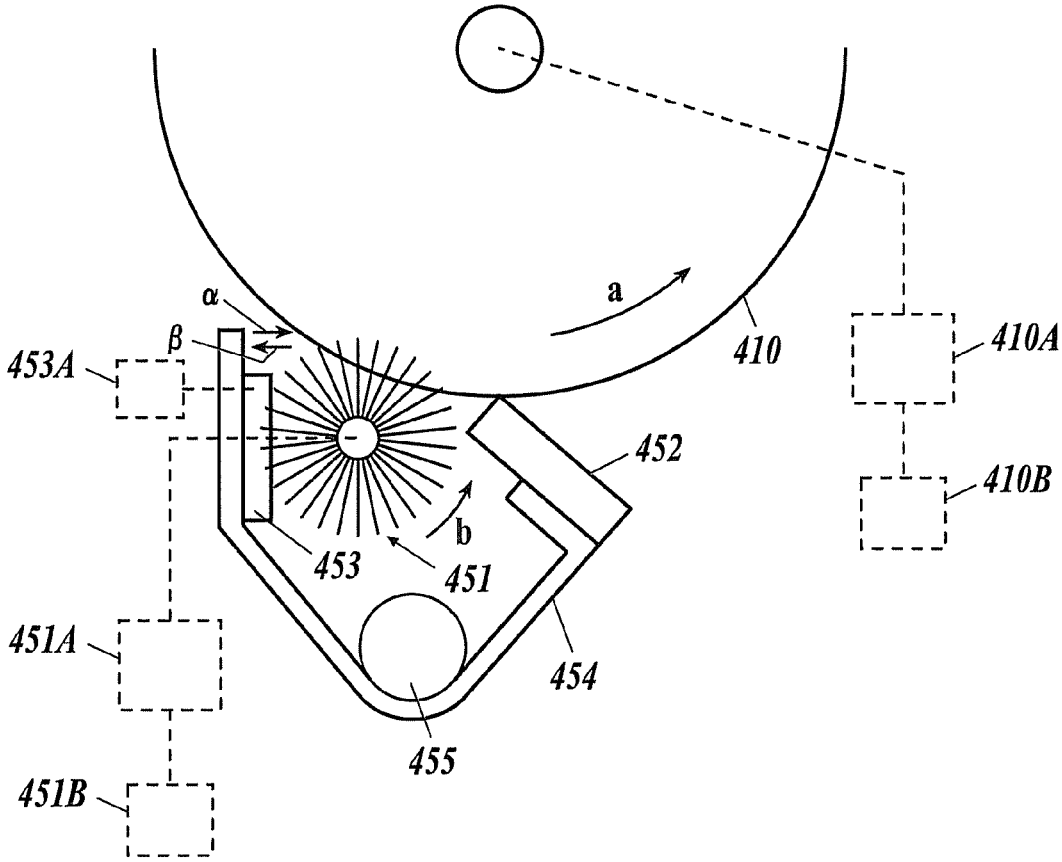
FIG. 3 is an enlarged sectional view showing a vicinity of a cleaning section.

FIG. 3 is an enlarged sectional view in the vicinity of the cleaning section.

Because the cleaning section in each of the image formation engines 400Y, 400M, 400C, and 400K is configured to be the same configuration, the cleaning section 450 in the image formation engine 400Y for yellow color will be adopted to be described in detail here.

As shown in FIG. 3, the cleaning section 450 chiefly comprises the brush 451, a cleaning blade 452, and a flicker 453. The cleaning blade 452 is installed in the downstream side of the photosensitive body 410 in the rotation direction with respect to the brush 451.

The brush 451 removes the toner remaining on the photosensitive body 410 by scrubbing the surface of the photosensitive body 410.

The brush 451 is configured by planting bristles formed out of, for example, nylon or polyester (each bristle has the length of from 4 to 5 mm) on a base cloth, and by winding the base cloth around a metal roller.

The photosensitive body 410 is rotated in an "a" direction by the drum driving motor 410A, and the brush 451 is reversely rotated in a "b" direction by the brush driving motor 451A. The rotation speed of the photosensitive body 410 is generally 90 rpm, and the rotation speed of the brush 451 is generally 195 rpm on the other hand. Incidentally, a drum torque meter 410B is connected to the drum driving motor 410A, and the rotary torque of the drum driving motor 410A is measured with the drum torque meter 410B. A brush torque meter 451B is connected to the brush driving motor 451A, and the rotary torque of the brush driving motor 451A is measured with the brush torque meter 451B.

The cleaning blade 452 is configured by an elastic member, for example, polyurethane rubber. The toner removed with the cleaning blade 452 is taken into the housing 454 of the cleaning section 450, and is gathered to a predetermined position with a recovery screw 455.

The flicker 453 is contacted with the bristles of the brush 451, and has a function of scraping off the toner adhering to the bristles. Moreover, a flicker moving motor (flicker moving section) 453A is connected to the flicker 453, and thereby the flicker 453 can move in an α direction and a β direction shown in FIG. 3. When the flicker 453 moves in the α direction, the contacting area of the flicker 453 with the bristles of the brush 451 becomes wider. Consequently, more toner can be removed from the bristles with the flicker 453.

Now, when a great deal of toner is adhered to the brush 451 in the cleaning section 450 shown in FIG. 3, the adhering toner is broken to be smaller by being scrubbed by the brush 451 and the photosensitive body 410. Then, there is a problem that, when the broken toner is transferred to the photosensitive body 410 and reaches the cleaning blade 452, the toner is pressed by the cleaning blade 452 and is fused onto the photosensitive body 410.

In order to prevent a great deal of toner from adhering to the brush 451, it is conceivable to increase the rotation speed of the brush 451 to remove the toner adhering to the brush 451 with the flicker 453. However, when the rotation speed of the brush 451 is always kept at a high speed, it is also conceivable to damage the photosensitive body 410 by the scrubbing the bristles of the brush 451 thereto.

Subsequently, the rotation speed of the brush 451 is accordingly set to be increased when the quantity of the toner adhering to the brush 451 is obtained and there is a large quantity of the toner adhering to the brush 451. This point will be described in detail with reference to FIGS. 4, 5A and 5B.

Figure 4:
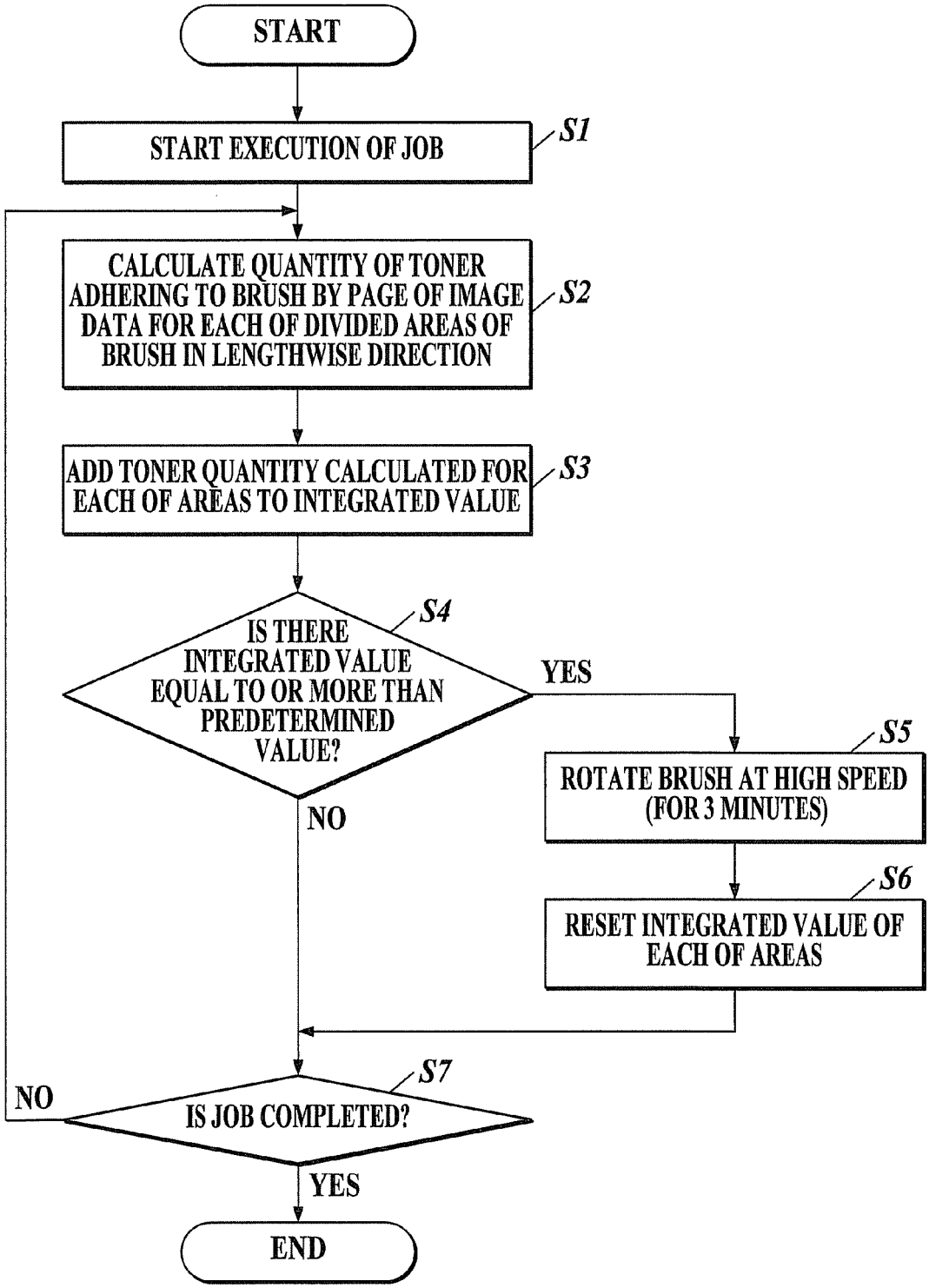
FIG. 4 is a flow chart pertaining to an operation of changing a rotation speed of a brush based on the quantity of a toner adhering to the brush.

FIG. 4 is a flow chart pertaining to the operation to change the rotation speed of the brush 451 based on the quantity of the toner adhering to the brush 451.

When the execution of a job is first started in the image forming apparatus 1 (Step S1), the quantity of the toner adhering to the brush 451 (hereinafter referred to as a toner adhesion quantity X) is calculated by the page of image data for each of a plurality of divided areas of the brush 451 in the lengthwise direction (Step S2).

When a great deal of toner is adhered to even a part of the brush 451, the toner fusion described above occurs. It is accordingly preferable to divide the brush 451 into the plurality of areas in the lengthwise direction to obtain how much the toner has adhered in each area. This point will be described in detail by the use of FIGS. 5A and 5B.

Figure 5A:
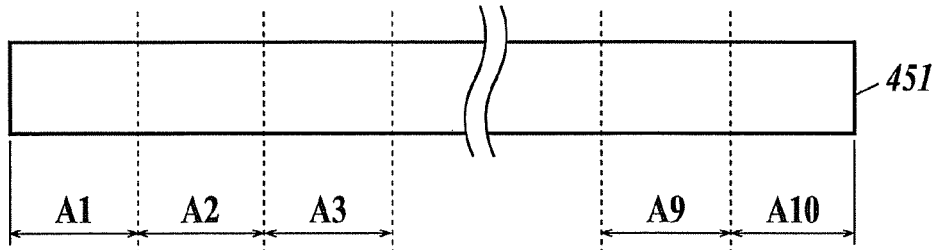
FIGS. 5A and 5B are explanatory diagrams showing a relation between the brush and image data in a lengthwise direction.
Figure 5B:
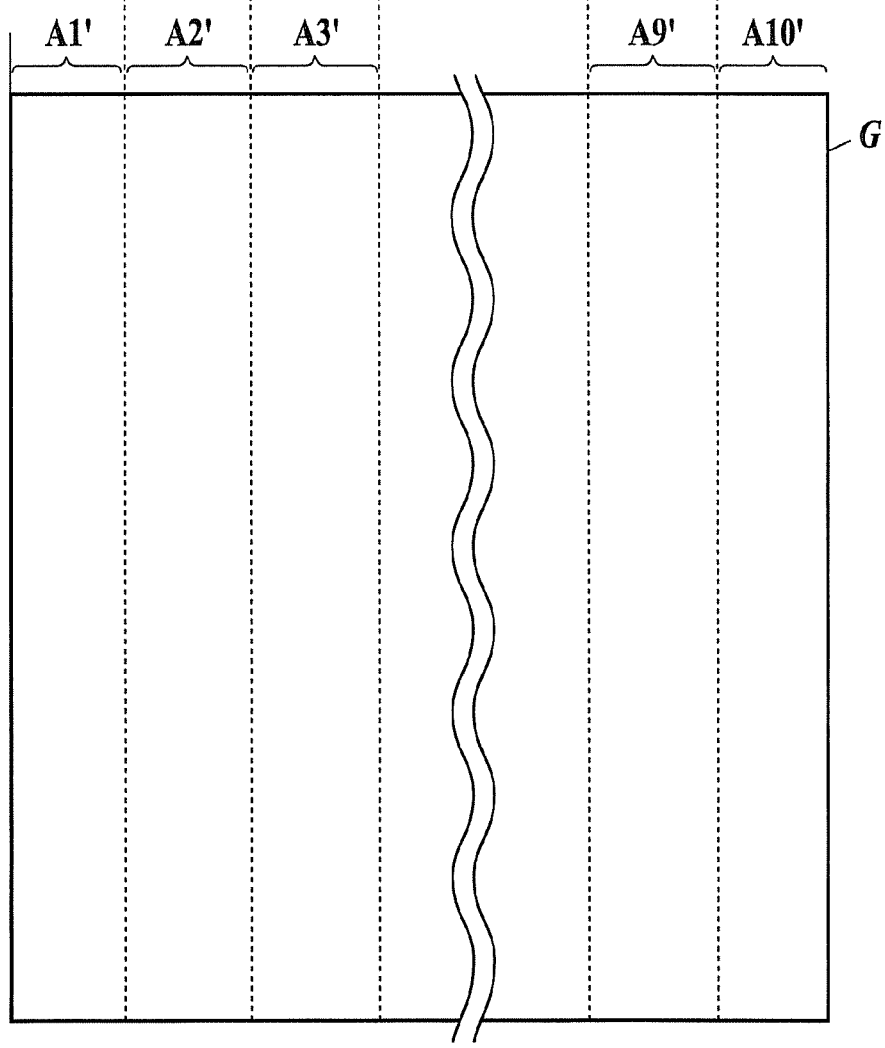

FIGS. 5A and 5B are an explanatory diagrams showing a relation between the brush 451 and image data G in the lengthwise direction.

FIG. 5A shows a plurality of divided areas of the brush 451 in the lengthwise direction and, for example, the brush 451 is divided into ten areas of A1-A10 as shown in FIG. 5A. It is then obtained how much toner has been adhered in each area.

The toner adhesion quantity X in each area is obtained by a predetermined arithmetic expression for every page of image data.

FIG. 5B shows the image data G for one page. For example, when a toner image is formed on the photosensitive body 410 based on the data in an area A1' of the image data G and the toner image is transferred to a sheet S, the toner remaining at the part of the photosensitive body 410 corresponding to the area A1' reaches the area A1 of the brush 451. It is conceivable that a certain rate of the toner that has reached the area A1 adheres to the area A1.

In the following, a calculation method of the toner adhesion quantity X per page of image data in the area A1 will be described.

A toner quantity W to be used for image formation, that is, the toner quantity before transfer which toner adheres to the photosensitive body 410 at the time of image formation, is first calculated based on the image data in the area A1'. The toner quantity W to be used for image formation is calculated by multiplying the toner quantity to be used for one dot by the number of printing dots in the area A1' of the image data.

Next, humidity is detected with a humidity sensor installed in the image forming apparatus 1, and a transfer rate T is obtained based on the detection result. A data table defining the relations between humidity and transfer rates T as Table 1 is stored in the ROM 102, and the transfer rate T is obtained by referring to the data table. For example, when the humidity is 50%, the transfer rate T results in 0.90.

TABLE 1

| Humidity (%) | Transfer Rate T |
|---|---|
| 0-20 | 0.96 |
| 21-40 | 0.93 |
| 41-60 | 0.90 |
| 61-80 | 0.88 |
| 81-100 | 0.85 |

Moreover, it is considered that the toner after transfer reaches the brush 451 and a certain rate of the reached toner adheres to the brush 451, and the certain rate is, for example, 50% (0.5).

Accordingly, the toner adhesion quantity X in the area A1 for a page of image data is led to be calculated by the following formula (1).

$$(\text{toner adhesion quantity } X)=(\text{toner quantity } W \text{ to be used for image formation})\times(\text{transfer rate})\times 0.5 \quad (1)$$

In the above, the calculation method of the toner adhesion quantity X in the area A1 for a page of image data has been described, and the toner adhesion quantities X can be similarly calculated for the other areas A2-A10.

Returning to FIG. 4, the description of the flow chart continues.

When the quantity of the toner adhering to the brush 451 by the page of image data has been calculated at Step S2, the calculated toner quantity is added to the integrated value for each area of the brush 451 (Step S3).

The integrated value is stored in the RAM 103 for each area, and ten integrated values of the areas A1-A10 are stored in the RAM 103 in the case of the example shown in FIGS. 5A and 5B. Because the toner adhesion quantity X for a page of image data has been calculated for each area at Step S2, how much toner has adhered to the brush 451 is obtained by adding the calculated value to the integrated value in the same area.

Next, it is judged whether there is any integrated value equal to or more than a predetermined value among the integrated values of the respective areas or not (Step S4). The predetermined value is a previously determined numerical value, and is a threshold value above which the toner adhering to the brush 451 can cause a problem.

When it is judged that no integrated values are equal to and more than the predetermined value (Step S4; No), then it can be obtained that not so much toner adheres to the brush 451 yet, and the rotation speed of the brush 451 is not increased accordingly. The operations from Step S2 to Step S4 are repeated until the job has been completed.

On the other hand, when it is judged that there is an integrated value equal to or more than the predetermined value (Step S4; Yes), it can be obtained that a great deal of toner has adhered to the brush 451, and, when nothing is done, the aforesaid toner fusion is led to occur.

The brush driving motor 451A is controlled to increase the rotation speed of the brush 451 accordingly, and the brush 451 is rotated at a high speed for three minutes (Step S5). For example, the rotation speed of the brush 451 is set to 250 rpm. The toner adhering to the brush 451 is thereby removed by the flicker 453, and the aforesaid toner fusion can be prevented. Moreover, because the rotation speed of the brush 451 is increased only in a fixed case, the damage of the photosensitive body 410 can be prevented. Incidentally, the time amount of three minutes is only an example, and the other amount of time may be set.

Moreover, when it is judged that there is an integrated value equal to or more than the predetermined value, then it is also conceivable to move the flicker 453 in the direction toward the brush 451 (in the a direction in FIG. 3). The removal rate of toner from the brush 451 can be thereby improved.

When the rotation at the high speed for three minutes has been completed, much toner adhering to the brush 451 in all areas thereof can be removed. The integrated value in each area is reset (Step S6) accordingly, and the operations from Step S2 to Step S4 are repeated.

As described above, when the quantity of the toner adhering to the brush 451 is obtained and the rotation speed of the brush 451 is changed based on the obtained toner quantity, then it becomes possible that the adherence of much toner to the brush 451 is prevented, and that the toner fusion on the image carrier, such as the photosensitive body and the like, is decreased.

Moreover, it is also conceivable to obtain the quantity of the toner adhering to the brush 451 based on the rotary torque of the brush driving motor 451A and the rotary torque of the drum driving motor 410A differently from the processing shown in FIG. 4. When a great deal of toner has adhered to the brush 451, a load is imposed on the rotations of the brush 451 and the photosensitive body 410 by the adhering toner, and the rotary torque of the brush driving motor 451A and the rotary torque of the drum driving motor 410A increase. The quantity of the toner adhering to the brush 451 can be obtained by monitoring the rotary torque accordingly. This point will be described with reference to FIG. 6.

Figure 6:
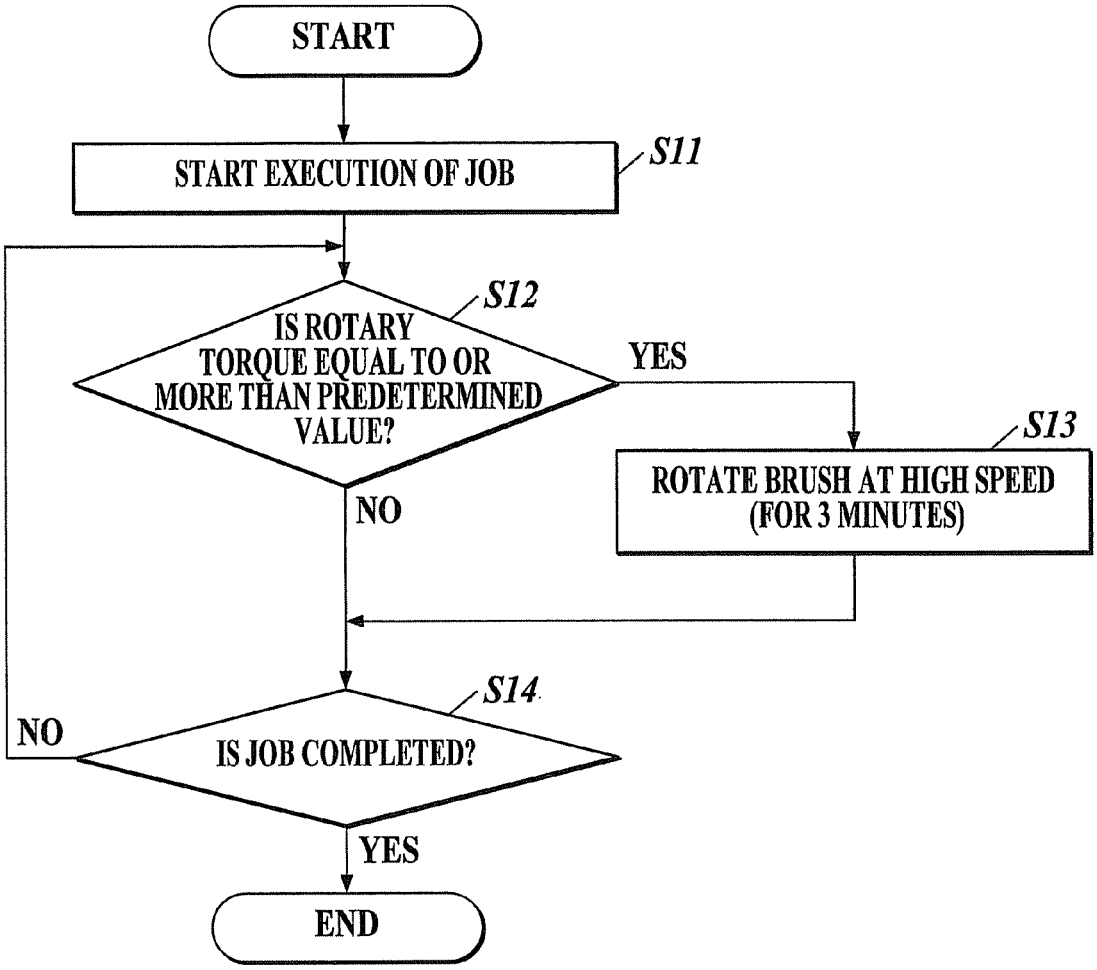
FIG. 6 is a flow chart pertaining to an operation of changing the rotation speed of the brush based on a value of rotary torque.

FIG. 6 is a flow chart pertaining to the operation for changing the rotation speed of the brush 451 based on the value of rotary torque.

When the execution of the job is started by the image forming apparatus 1 (Step S11), it is judge whether either of the rotary torque of the brush driving motor 451A and the rotary torque of the drum driving motor 410A is equal to or more than the a predetermined value or not (Step S12). The measurement of the rotary torque is performed by using the brush torque meter 451B and the drum torque meter 410B, both shown in FIG. 3.

When either of the rotary torque of the brush driving motor 451A and the rotary torque of the drum driving motor 410A is not equal to or more than the predetermined value (Step S12; No), then it can be obtained that not so much toner adheres to the brush 451. Accordingly, the rotation speed of the brush 451 is not increased. The operations of from Step S11 to Step S12 are then repeated until the job is completed.

On the other hand, when either of the rotary torque of the brush driving motor 451A and the rotary torque of the drum driving motor 410A is equal to or more than the predetermined value, then it can be obtained that a great deal of toner adheres to the brush 451. Then, when nothing is done, the aforesaid toner fusion is led to occur.

Accordingly, the brush driving motor 451A is controlled to increase the rotation speed of the brush 451, and the brush 451 is rotated at a high speed for three minutes (Step S13). The toner adhering to the brush 451 is thereby removed by the flicker 453, and the aforesaid toner fusion can be prevented. Moreover, because the rotation speed of the brush 451 is increased only in a fixed case, the damage of the photosensitive body 410 can be prevented.

Further, when either of the rotary torque of the brush driving motor 451A and the rotary torque of the drum driving motor 410A is equal to or more than the predetermined value, it is also conceivable to move the flicker 453 in the direction toward the brush 451 (in the α direction in FIG. 3). The removal rate of toner from the brush 451 can be thereby improved.

When the high speed rotation for three minutes has been completed, the operations from Step S11 to Step S12 are repeated until the job is completed.

As described above, because the quantity of the toner adhering to the brush 451 can be obtained also by the method described with reference to FIG. 6, it is possible to prevent the adherence of so much toner to the brush 451, and to decrease the toner fusion on the image carrier, such as the photosensitive body and the like, by changing the rotation speed of the brush 451 based on the toner quantity obtained similarly to the method described with reference to FIG. 4.

Incidentally, the present invention is not limited to the embodiments, but the modifications and addition within a scope not to depart from the sprit of the present invention are included in the present invention.

The present U.S. patent application claims a priority under the Paris Convention of Japanese patent application No. 2007-153751 filed on Jun. 11, 2007, which shall be a basis of correction of an incorrect translation.

What is claimed is:

1. An image forming apparatus, comprising:

an image carrier;

a brush to remove toner remaining on the image carrier by scrubbing a surface of the image carrier;

a flicker to remove the toner adhering to the brush by contacting the brush;

a brush driving section to rotate the brush; and a control section to obtain a quantity of the toner adhering to the brush and to control the brush driving section so as to change a rotation speed of the brush based on the obtained quantity of the toner;

wherein the control section obtains the quantity of the toner adhering to each of a plurality of divided areas of the brush in a lengthwise direction, to change the rotation speed of the brush based on the obtained quantity of the toner adhering to each of the areas.

2. The image forming apparatus of claim 1, further comprising a cleaning blade to remove the toner remaining on the image carrier, on a downstream in a rotation direction of the image carrier with respect to the brush.

3. The image forming apparatus of claim 2, wherein the control section obtains the quantity of the toner based on rotary torque in the brush driving section.

4. The image forming apparatus of claim 1, further comprising an image carrier driving section to rotate the image carrier, wherein the control section obtains the quantity of the toner based on rotary torque in the image carrier driving section.

5. An image forming apparatus, comprising:

an image carrier;

a brush to remove toner remaining on the image carrier by scrubbing a surface of the image carrier;

a flicker to remove the toner adhering to the brush by contacting the brush;

a brush driving section to rotate the brush;

a control section to obtain a quantity of the toner adhering to the brush and to control the brush driving section so as to change a rotation speed of the brush based on the obtained quantity of the toner; and a flicker moving section to move the flicker with respect to the brush, wherein the control section controlling the flicker moving section based on the obtained quantity of the toner adhering to the brush.

* * * * *